US005584075A

United States Patent [19]

Bae et al.

[11] Patent Number: 5,584,075

[45] Date of Patent: Dec. 17, 1996

[54] NECKTIE WITH A KNOT-FORMING CORE FOR ENABLING ASSEMBLY AND DISASSEMBLY OF THE KNOT

[76] Inventors: Tae-Young Bae; Sue-Joung Bae; Young-Ook Bae, all of Dongjakku, Sadangdong San 17, Kukdong Apt, 101 dong 902 ho, Seoul, Rep. of Korea

[21] Appl. No.: 364,470

[22] Filed: Dec. 27, 1994

[30] Foreign Application Priority Data

| | | | |
|---|---|---|---|
| Dec. 24, 1993 | [KR] | Rep. of Korea | 94-26642 |
| Mar. 3, 1994 | [KR] | Rep. of Korea | 94-26643 |

[51] Int. Cl.[6] ..... A41D 25/08

[52] U.S. Cl. ..... 2/152.1; 2/144; 2/148

[58] Field of Search ..... 2/152.1, 144, 145, 2/148, 149, 150, 153, 155, 156, 157

[56] References Cited

U.S. PATENT DOCUMENTS

| | | | |
|---|---|---|---|
| 4,024,585 | 5/1977 | Girdler . | |
| 4,173,792 | 11/1979 | Intengan | 2/150 |

FOREIGN PATENT DOCUMENTS

| | | | |
|---|---|---|---|
| 85-572 | 1/1985 | Rep. of Korea . | |
| 86-686 | 1/1986 | Rep. of Korea . | |
| 86-13318 | 8/1986 | Rep. of Korea . | |
| 87-13436 | 8/1987 | Rep. of Korea . | |
| 88-10198 | 6/1988 | Rep. of Korea . | |
| 88-14811 | 11/1991 | Rep. of Korea . | |
| 2189980 | 11/1987 | United Kingdom | 2/144 |
| WO7900894 | 11/1979 | WIPO | 2/144 |

*Primary Examiner*—C. D. Crowder
*Assistant Examiner*—Gloria Hale
*Attorney, Agent, or Firm*—Oblon, Spivak, McClelland, Maier & Neustadt, P.C.

[57] ABSTRACT

A necktie with a knot-forming core includes a necktie body made of cloth and a knot-forming core made of synthetic resin. The necktie body has a necktie panel having a combining hole at a top portion thereof, a knot-cloth sewed to the knot-forming position of the panel and a pair of combining holes at lower corners thereof, and a pair of necktie-arms sewed to the respective upper corners of the knot-cloth which are used for attaching the necktie to shirts of blouses. The knot-forming core includes a core-body and a combining projection provided on the back of the core-body. A Y-shaped necktie having a desired size and shape is assembled merely by placing the core on the back of the knot-forming position of the necktie-body, and thereafter orderly fitting the above-mentioned three combining holes around the combining projection of the core. The Y-shape necktie thus assembled is maintainable, disassemblable, and reassemblable. The Y-shaped necktie can be put on or taken off simply by using an attaching tool like a VELCRO hook and loop fastener, hooks, pressstuds, or magnets, attached both at the necktie-arms and the shirt; a band detachably connected to one of the necktie-arms and which is connected to the above-mentioned attaching tools both at its other end and the necktie-arm. A string movably passes through the core, whose length is adjustable simply by pressing or releasing the projection on the back of the core.

6 Claims, 8 Drawing Sheets

NECKTIE WITH A KNOT-FORMING CORE FOR ENABLING ASSEMBLY AND DISASSEMBLY OF THE KNOT

BACKGROUND OF THE INVENTION

1. Field of the Invention

The present invention relates to a necktie, which simplifies the forming of the knot by using a knot-forming core made of synthetic resin or other material, and which enables maintaining of the knot once it is formed, which facilitates putting on and taking off of the necktie by applying one of the attaching means suggested below, and which enables disassembling and reassembling of the knot when washing or ironing is needed.

2. Description of the Prior Art

As for the traditional necktie, the user must surround the narrow part of the necktie-panel around the neck under the collar of the shirt or blouse each time he or she wants to put it on. Therefore the process of putting on and taking off the necktie is inconvenient and takes a significant amount of time. Moreover, the user has to tighten the necktie in order to exhibit a good appearance, which inevitably results in compression of the user's neck, and possibly causes impediments in blood circulation or breathing.

In efforts to overcome the above problems of the traditional necktie, neckties with ready-made knots have been proposed such as those Korean Utility Model Application Nos. 85-572, 86-13318, 86-686, 87-13436, 88-10198, and 88-14811. However, these neckties with ready-made knots are not practical nor convenient to put on, and the ready-made knots cannot be easily disassembled, whereby washing and ironing of it becomes almost impossible.

SUMMARY OF THE INVENTION

The object of the present invention is to provide a necktie with a knot-forming core (hereinafter referred to simply as a core), in which all of the above-noted problems can be solved.

The necktie of the present invention is composed of a necktie-body made of cloth and a knot-forming core made of synthetic resin or other material. Merely by assembling the above two parts, the user can easily form the knot and thus form the Y-shaped necktie which has a necktie-panel, a knot, and a pair of arms for attaching the necktie to a shirt or a blouse. As the knot is so made that the knot-shape can be maintained once it is made, the user can put on and take off the necktie very conveniently simply by applying some of the following attaching means. The knot is also so made that it can be easily disassembled and reassembled when washing and ironing is needed. Therefore, the method of forming the knot is the essential part of this invention.

As for the attaching means of the present invention, there is provided three types of preferred embodiments as useful examples: a basic-type, a band-type, and a string-type.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DESCRIPTION OF THE PREFERRED EMBODIMENTS

As described above, the Y-shaped necktie is formed merely by assembling the necktie-body made of cloth and the knot-forming core made of synthetic resin or other material. After forming the Y-shaped necktie, the user may put on and take off the necktie simply by using one type of attaching means or another. Here, three types of preferred embodiments (basic-type, band-type, and string-type) classified according to the attaching means are suggested and will be separately described as follows.

1. Forming and Wearing of Basic-Type Necktie (1st Embodiment)

Figure 1:
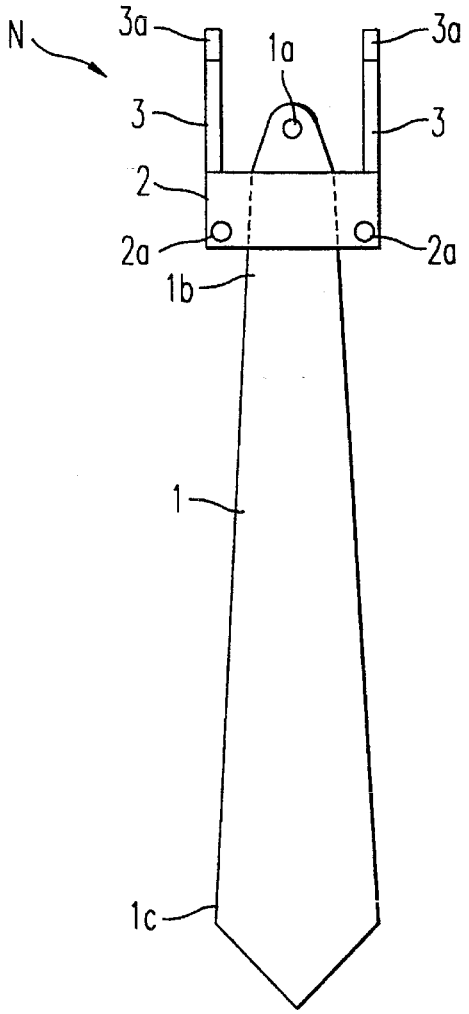
FIG. 1 is a front view of the necktie-body.
Figure 2:
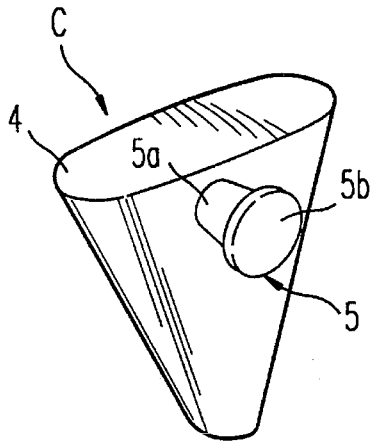
FIG. 2 is a perspective view of the knot-forming core made of synthetic resin or other material.
Figure 3A:
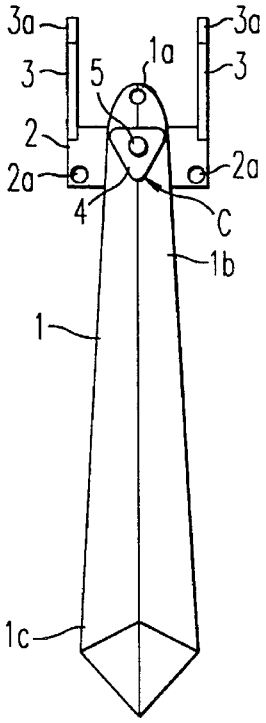
FIGS. 3-A to 3-D are rear views of the necktie-body, showing the process for forming the knot using the core.
Figure 3B:
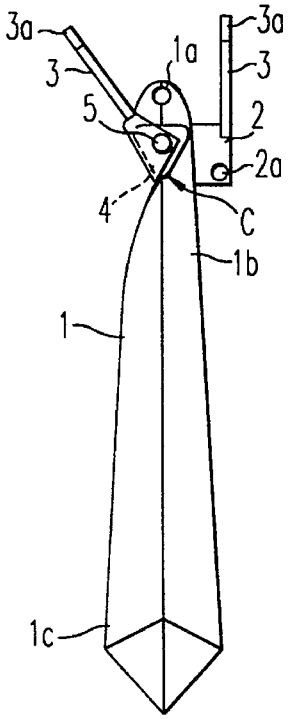
Figure 3C:
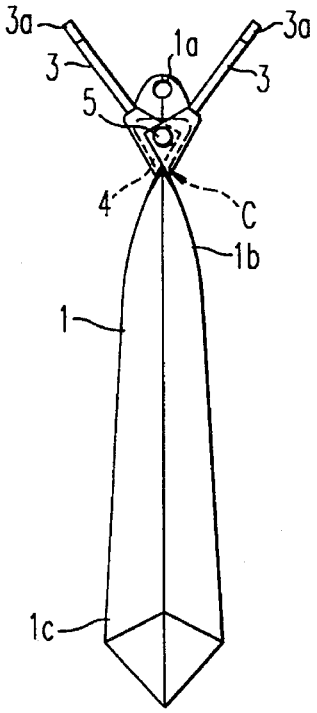
Figure 3D:
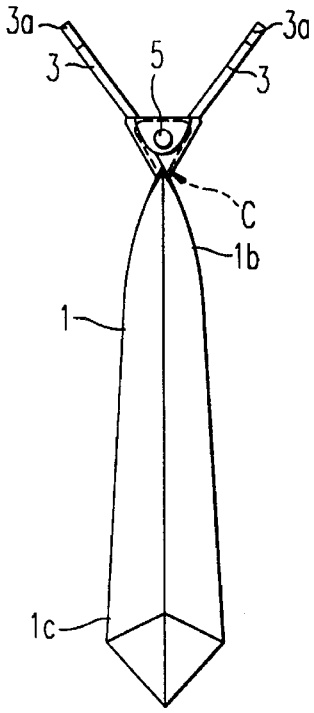

The basic type necktie composed of a necktie-body N and a core C is produced as follows. As shown in FIG. 1, the necktie-body N comprises three components; a necktie-panel 1, a knot-cloth 2, and a pair of necktie-arms 3. The necktie-panel 1 has a shape such as results when one cuts off a traditional necktie at a position spaced about 3 cm above the desired knot-forming position. The necktie-panel has a combining hole l*a* at its top 1*b* (i.e. narrower part) for combining the necktie-body and the core and has a bottom 1*c*.

The knot-cloth 2 is a rectangular piece of cloth having a predetermined width and a length corresponding to the size of the desired knot. The knot-cloth has a pair of combining holes 2*a*,2*a* in each of its lower corners. The knot-cloth 2 is to be sewed to the necktie-panel 1 at the desired knot-forming position, crossing with the necktie-panel at the right angle.

A pair of necktie-arms 3 is to be sewed to each of the upper corners of the knot-cloth 2. On the free end of each of the necktie-arms 3 is attached an attaching tool 3*a* such as a VELCRO hook and loop fastener, hooks, pressstuds, or magnetic snap-fastener.

As shown in FIGS. 2, 5, 6, 7, the knot-forming core C has two elements, the core-body 4 having the same shape and size as the desired knot, and the projected part on a back portion thereof for combining the necktie-body and the core (hereinafter the projected part is referred to as the combining projection or the simply the projection). Both elements are integrally made of synthetic resin or other hard material in one molding.

The combining projection is to be made, such that the inner part thereof (where it attaches the core-body) has a small diameter while the outer part thereof has a larger diameter or a larger diameter disc, in order to prevent the combining holes 1*a*,2*a*,2*a*, of the necktie-body N from drifting away from the projection after they have been combined with the core, thereby achieving a more stable combination of the necktie body and, the core.

After production of both the necktie-body N and the core C, the combining process of the two is as shown in FIGS. 3-A to 3-D, namely: first the core is placed on the rear side of the necktie-body at the knot-forming position with the projection upright (FIG. 3-A), then the two combining holes 2*a*,2*a* of the knot-cloth 2 are to be fitted around the projection 5 of the core C (FIGS. 3-B, 3-C), and then the combining hole (la) of the necktie-panel 1 is fitted around the projection 5 of the core C (FIG. 3-D).

Figure 4:
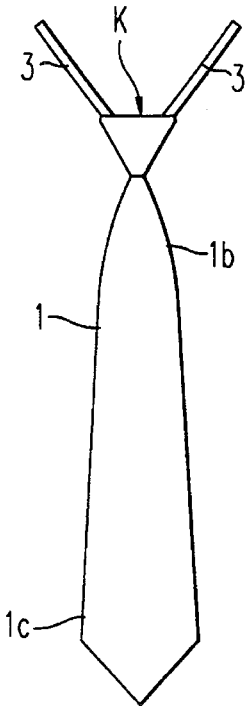
FIG. 4 is a front view of the completed Y-shaped necktie, which has a necktie-panel, a knot, and a pair of arms for attaching.
Figure 5:
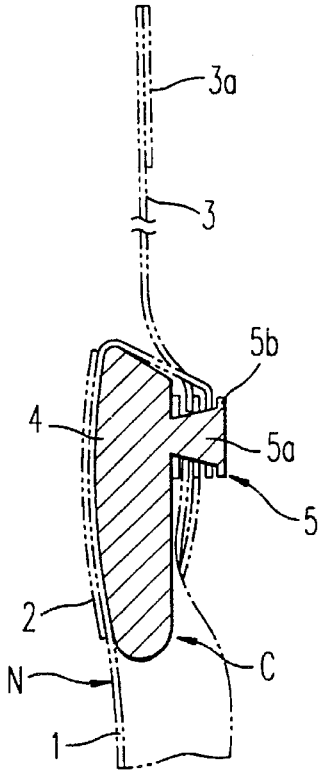
FIG. 5 is a sectional view of the core, as shown when the knot is formed.

Having finished the above process of combining the three holes around the projection, the necktie-knot is completed, and the user can have a Y-shaped necktie having a necktie-panel, a triangular knot K, and a pair of necktie-arms 3 at each of the two top corners of the knot (FIG. 4).

Figure 6:
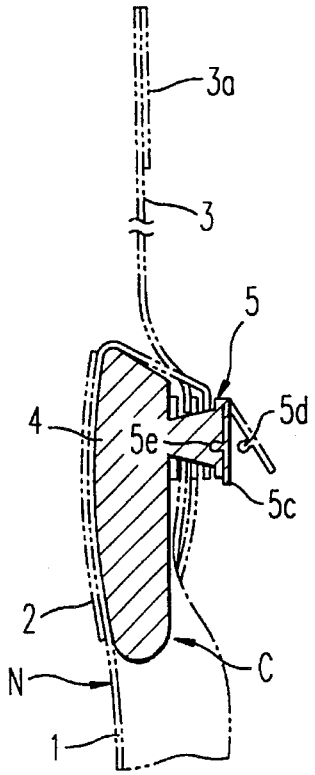
FIG. 6 is a sectional view of another type of core which has a locking-slot in a projection thereof and a cover (i.e. projection-cover) with a locking-pin hinged on an outer end of its projection.

If the combining projection has a locking slot 5*e* and a cover 5*c* (hereinafter referred to as the projection-cover) which has a larger diameter than the projection and which has a counterpart locking-pin 5*d* to be snapped into the locking pin 5*e* as shown in FIG. 6, the user can tighten the necktie-body and the core by snapping the pin 5*d* and the slot 5*e* together after fitting the combining holes l*a*,2*a*,2*a* of the necktie-body around the projection of the core 5.

Figure 7:
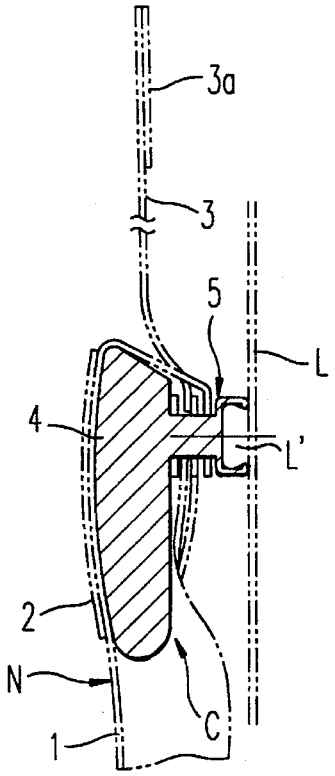
FIG. 7 is a sectional view of still another type of the core which has a U-shaped pressstud.
Figure 8A:
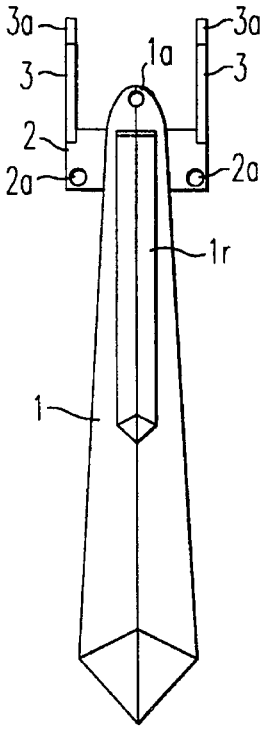
FIGS. 8-A to 8-E rear views of another type of the necktie-body which has an additional back-panel, showing the process for forming the knot.
Figure 8B:
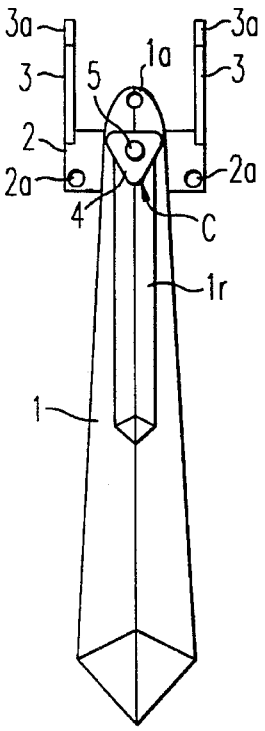
Figure 8C:
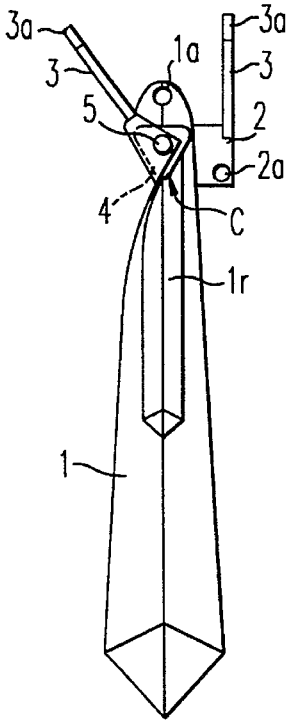
Figure 8D:
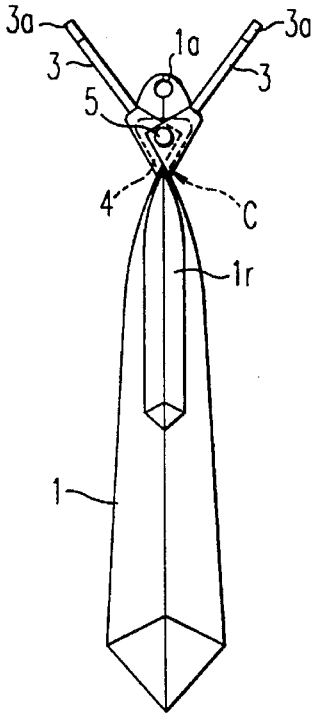
Figure 8E:
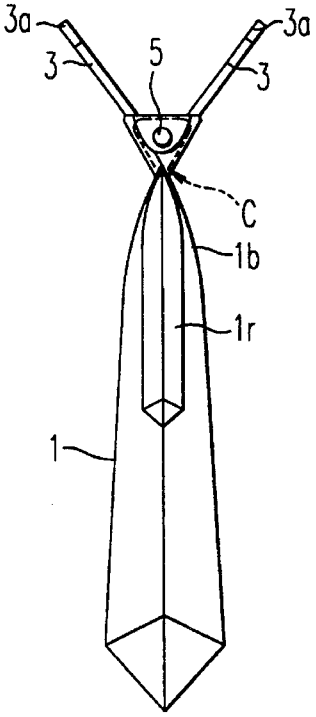
Figure 9A:
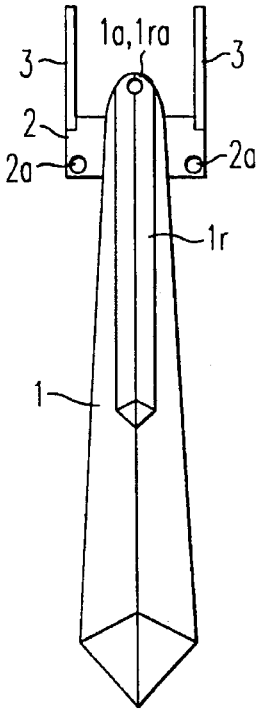
FIGS. 9-A to 9-E are the rear views of still another type of the necktie-body which has an additional back-panel, showing the process for forming the knot.
Figure 9B:
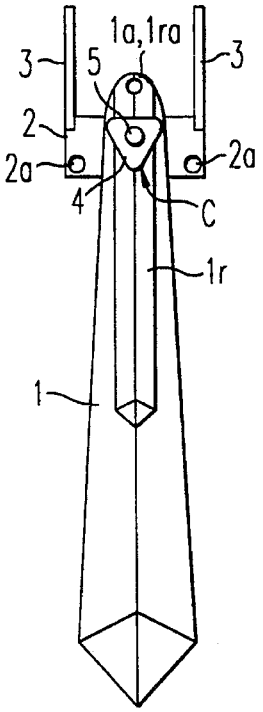
Figure 9C:
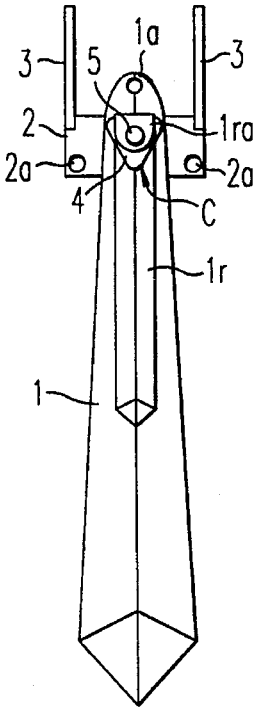
Figure 9D:
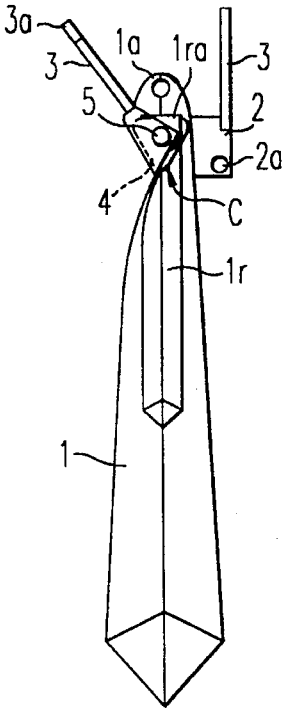
Figure 9E:
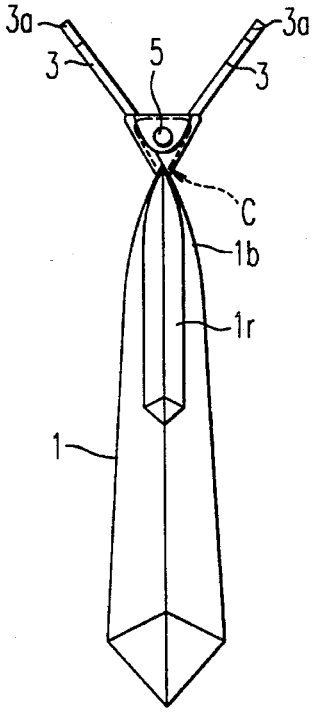

On the other hand, if the rear end of the projection 5 of the core C is made of a U-shaped pressstud as shown in FIG. 7, the user can put on the Y-shaped necktie simply by fastening the U-shaped pressstud to the counterpart inverted T-shaped pressstud L' which is attached to the top button-hole place of the shirt- or blouse- lapel L.

The Y-shaped necktie whose knot K is formed as described above is very easily put on or taken off, simply by attaching or unattaching the attaching tools at each of the necktie-arms, such as VELCRO hook and loop fastener pressstuds, or a magnetic snap-fastener to or from the counterpart attaching tools attached on the cloth under the collar of the shirt or blouse. The user can also tighten or loosen the necktie simply by choosing the attaching position of the above-noted attaching tools.

For those who prefer to have a traditional style necktie which has an additional narrower back-panel when the knot is formed, the Y-shaped necktie can also be furnished with an additional back-panel l*r*. The narrower back-panel l*r* can be attached to the rear side of the necktie-panel 1 as shown in FIG. 8, or it can be separately prepared as shown in FIG. 9. When a separate back-panel is used, it must have a combining hole l*ra* at the top of it, and the user must position the hole l*ra* of the back panel around the projection of the core before positioning the holes 2*a*,2*a*,l*a* of the knot-cloth and the necktie-panel as shown in FIGS. 9-A to 9-E.

2. Forming and Wearing of Band-Type Necktie (2nd Embodiment)

This embodiment is the one which enables the user to put on the above-mentioned Y-shaped necktie by using a band.

Here, the process of forming the Y-shaped necktie by assembling the necktie-body N' and the core C is the same as in the basic-type. The only difference in the necktie-body N' in this embodiment is that at the free edge of one of the two necktie-arms 3 is located a hole 3*b* for connecting the band (hereinafter the hole is referred to as a connecting hole) as shown in FIG. 11.

Figure 10:
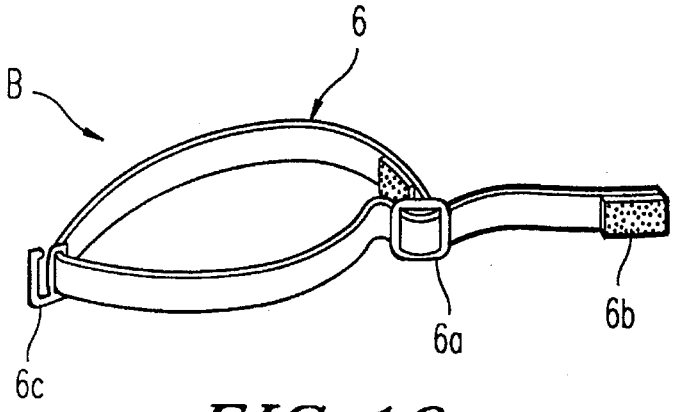
FIG. 10 is a perspective view of the necktie-band for the band-type.

As shown in FIG. 10, the band-B is so made that at the middle of band-body 6 is inserted a length-adjusting buckle 6*a*which has two rings, and to which is fixed one end of the band-body 6. On the band-body between the length-adjusting buckle and the above-mentioned end of the band-body is inserted a connecting hole 3*b* located at the edge of one of the necktie-arms 3. At the other end of the band-body is attached attaching tools 6*b* such as a VELCRO hook and loop fastener, hooks, or pressstuds. The band is so made that the user can adjust the length thereof according to his or her neck size simply by changing the position of the length-adjusting buckle 6*a* on the band-body, and can maintain the adjusted length once the length is adjusted.

Figure 11:
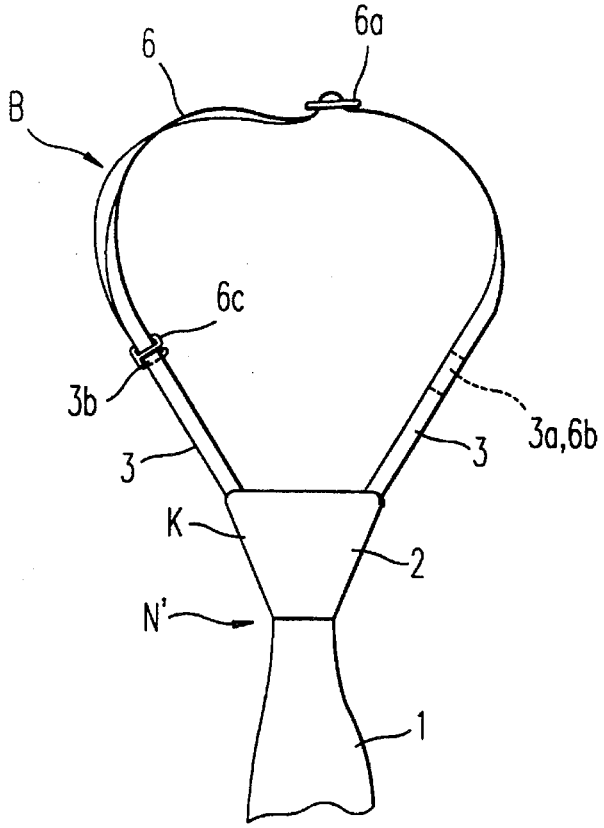
FIG. 11 is a partial front view of the completed necktie for the band-type.

The process of putting on the necktie with the band is as shown in FIG. 11. The user must first adjust the length of the band by manipulating the position of the length-adjusting buckle 6*a*, then connect the connecting hook 6*c* of the band to the connecting hole 3*b* in one of the necktie-arm 3, and then surround the band around the user's neck under the collar of the shirt or the blouse, followed by attaching the attaching tools attached at the other end of the band to the counterpart attaching tools attached at the other necktie-arm. The user can also tighten or loosen the necktie simply by changing the attaching position of attaching tools.

3. Forming and Wearing of String-Type Necktie (3rd Embodiment)

This embodiment enables the user to put on the above-mentioned Y-shaped necktie by using a string instead of the above-mentioned attaching tools such as VELCRO hook and loop fasteners.

Figure 12:
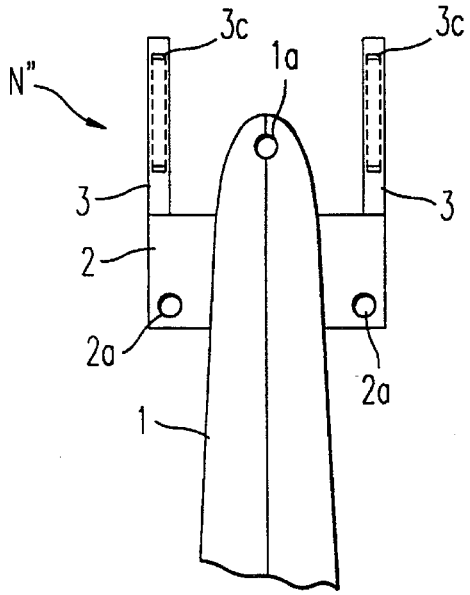
FIG. 12 is a partial rear view of the necktie-body for the string-type.

Here, the process of forming the Y-shaped necktie by assembling the necktie-body N" and the core C" is almost the same as in the basic-type. The difference in the necktie-body N of this embodiment is that each of the two necktie-arms here has a string-passageway 3*c*,3*c*, respectively, namely, hole-shaped tube through which each end of the string is to penetrate from top to bottom of the respective necktie-arm as shown in FIG. 12.

Figure 13:
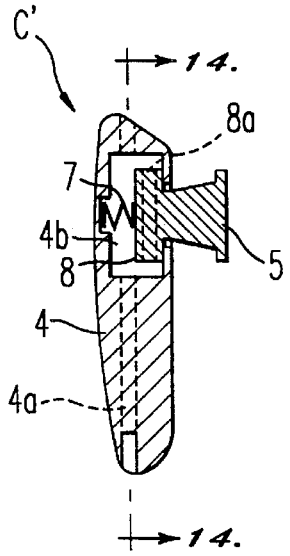
FIG. 13 is a sectional view of the core for the string-type.
Figure 14:
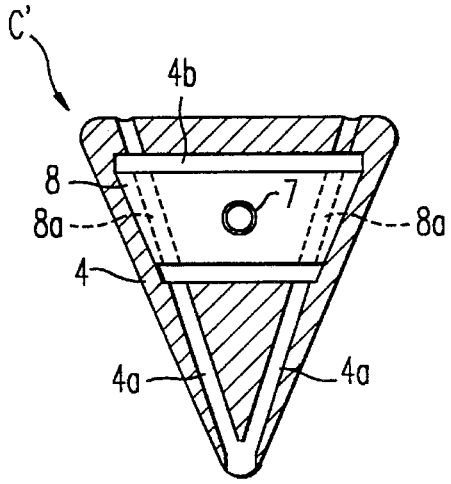
FIG. 14 is a sectional view of the core for the string-type, taken along line 14—14 of the FIG. 13.
Figure 15:
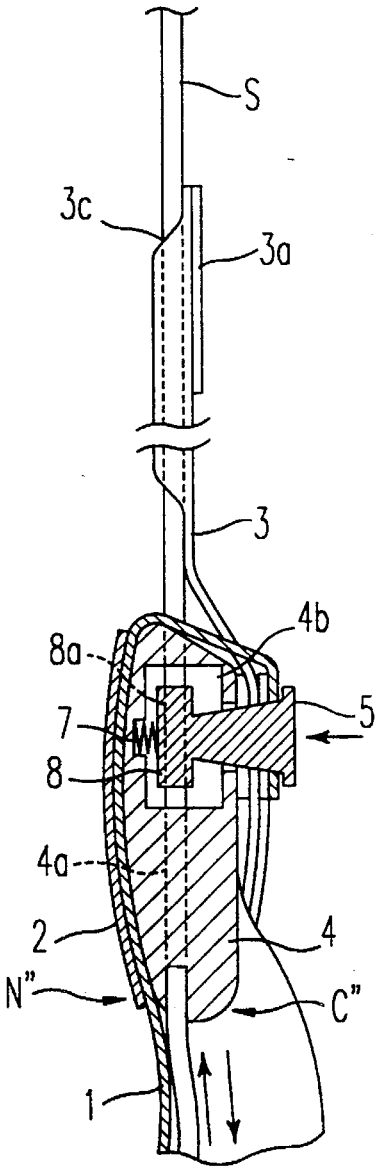
FIG. 15 is a sectional view of the core for the string-type, showing the state when the projection is pressed.
Figure 16:
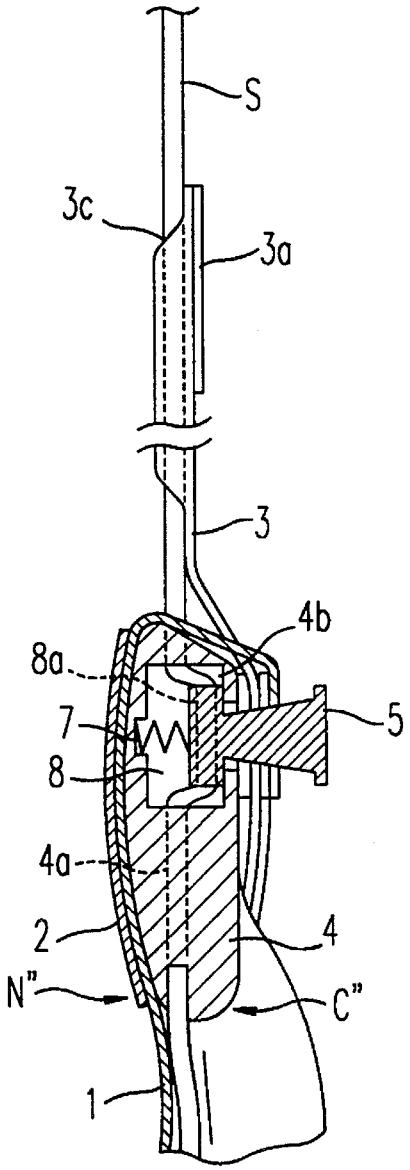
FIG. 16 is a sectional view of the core for the string-type, showing the state when the projection is released.

The knot-forming core C" of this embodiment is much different from that in the basic-type as shown in FIGS. 13 and 14. The core, too, must have two string-passageways 4*a*,4*a* which run from two places on the top to one common place at the bottom, in order for the two ends of the string to penetrate through and converge at the common bottom of the core. It must also have an inner cavity 4*b* in the interior of the core-body where a slider 8 and a spring 7 is to be installed.

The slider in the inner cavity, too, must have two string-passageways 8*a*,8*a* which run from top to bottom, in order for the two ends of the string to penetrate therethrough. Here, the combining projection 5 at the rear side of the core is not molded at the back of the core-body as in the basic-type but is integrally molded at the rear side of the slider, and is separated from the back surface of the core-body by a slight interval in order for the projection to be movable forward and backward together with the slider. A spring or other elastic material is to be installed in front of the slider, so that the slider can slide forward or backward in the inner cavity by means of the elasticity of the spring according as the combining projection is pressed or released.

After the slider and the spring have been properly installed, the inner cavity must be shielded with a cover 4*c* (hereinafter, the cover for inner cavity is referred to as the cavity-cover).

The core C" of this embodiment described above operates as follows. When the user presses the projection 5 at the rear of the core C", the slider 8 moves forward compressing the spring 7, and the two string-ways 8*a*,8*a* of the slider become aligned with the respective counterpart string-passageways 4*a*,4*a* of the core-body 4, thereby enabling the strings in the string-ways to move upward or downward. When the user releases the projection 5 at the rear of the core C", the slider 8 moves backward by the restoring force of the spring 7 and the two string-ways 8*a*,8*a* of the slider become misaligned with the respective string-ways 4*a*,4*a* of the core-body 4, thereby fixing the strings at their present position.

In this embodiment also the method of forming the Y-shaped necktie with the necktie-body N" and the core C" is almost the same as in the basic-type as shown in FIGS. 3-A to 3-D. The only difference is that, before combining the necktie-body and the core, the user must insert each end of string S into the respective string-passageways 3*c*,3*c* of the necktie-arms from top to bottom, then into the respective string-passageways 4*a*,4*a* of the upper part of the core-body 4, then into the respective string-passageways 8*a*,8*a* of the slider (here the user needs to press the projection of the core to align the string-passageways), and then into the respective string-passageways 4*a*,4*a* of the lower part of the core-body 4, until both ends of the string S penetrate out of the bottom of the core-body 4. When both ends of the string have been taken out of the bottom of the core, the string forms a tie-loop.

The procedure for putting and taking off the above Y-shaped necktie is as follows. By pressing the projection 5 of the core C", the user can loosen the tie-loop, then the user can hang the string around the collar of the shirt or blouse. In this state, the user can tighten or loosen the tie-loop simply by holding both ends of the string in one hand and pulling up and down of the core with the other hand while pressing the projection of the core. In order to take off the necktie, the user can loosen the tie-loop and take it off from under the collar of the shirt or blouse.

The main merit of the necktie of the present invention is that the user can form the knot very easily merely by assembling the necktie-body made of cloth and the core made of synthetic resin. Another merit is that, as the knot-shape is maintainable once it is formed, the user can put on or take off the necktie very conveniently simply by using attaching tools (such as VELCRO hook and loop fastener attached both at the necktie-arms and under the collar of the shirt or clothing) or a band or string. Still another merit is that the user can disassemble or reassemble the knot when washing and ironing is needed.

The necktie of the present invention exhibits a nice appearance without compressing the user's neck, and therefore causes no discomfort around the neck such as poor blood circulation or problems with breathing. In addition, the necktie of this invention is economical in that it uses about half the amount of fabric which is used in making a traditional necktie. Furthermore, contrary to traditional neckties which are sometimes used in such criminal acts as strangling or tying of the wrists or ankles, the necktie of this invention is safe from such criminal actions.

Obviously, numerous modifications and variations of the present invention are possible in light of the above teachings. It is therefore to be understood that within the scope of the appended claims, the invention may be practiced otherwise than as specifically described herein.

What is claimed:

1. A necktie with a knot-forming core, which includes a necktie-body comprising:

a necktie-panel which is cut at a position spaced substantially 3 cm above a desired knot-forming position, said necktie panel having a combining hole located at a top portion thereof;

a knot-cloth of a substantially rectangular shape having a predetermined width and length, said cloth having combining-holes located in two lower corners thereof, and being attached to the necktie-panel at a knot-forming position;

a pair of necktie-arms attaching the necktie to one of a shirt and another type of clothing, said necktie-arms being sewed at each of two upper corners of the knot-cloth respectively, each of said necktie-arms being provided on a respective free end thereof with an attaching tool wherein said attaching tool comprises one of a VELCRO hook and loop fastener, a hook, pressstuds, and a magnetic snap-fastener;

a knot-forming core comprising a core-body, and made of one of a synthetic resin and a hard material, and a combining projection connecting said necktie-body to said core-body said combining projection being provided on a back portion of said core-body such that said core-body is placed on the rear side of said necktie-body at the knot-forming position with the combining projection in an upright position, and said combining holes of the knot-cloth and of the necktie-panel are orderly fitted around said combining projection of the core-body, thus forming a Y-shaped necktie having a necktie-panel, a triangular knot and a pair of necktie-arms with attaching tools at each of two upper corners of the knot.

2. The necktie according to claim 1, wherein said combining projection has a locking slot in an interior portion thereof and a projection-cover hinged on an outer end thereof, said projection cover having a larger diameter than that of said combining projection and also having a locking pin which is snapped into said locking slot such that said projection cover is tightly closed by snapping together said locking pin and said locking slot after combining said necktie-body to said core-body, thus preventing separation of said necktie-body from said core-body.

3. The necktie according to claim 1, wherein the outer end of said combining projection is made of a U-shaped press-stud such that said necktie is put on and taken off respectively by fastening and unfastening of said U-shaped press-stud which is attached to a top button-hole place of one of a shirt and blouse lapel.

4. The necktie according to any one of claims 1 to 3, which comprises:

a back-panel provided at a back portion of necktie-panel, said back-panel being connected to said core-body along with said necktie-body.

5. The necktie according to any one of claims 1 to 3, which comprises:

a detachable band connected to one of the free ends of said necktie-arms by a connecting hook attached to said band and a connecting hole attached to said necktie-arm, said band having a length-adjustable buckle adjusting the length of the band and also having attaching tools such as one of a VELCRO hook and loop fastener, a hook, pressstuds, and magnetic snap-fastener, such that said band connected to the necktie-arm surrounds the neck of one of a shirt and blouse and thereafter the other end of said band having the attaching tool is one of attached to and unattached from the attaching tool attached at the other necktie-arm.

6. The necktie according to any one of claims 1 to 3, wherein an interior of each of said necktie-arms has a string-passageway from top to bottom, through which both ends of the string penetrates, respectively and said core-body comprises:

a pair of string-ways extending from a top portion to a common bottom portion of the core-body, through which both ends of said string penetrate and converge at the common bottom portion;

an inner cavity in an interior of the core-body wherein a slider and one of a spring and another elastic material is inserted;

said slider having in an interior portion thereof a pair of string-passageways through which both ends of said string pass, and also having at a rear side the combining projection;

said spring being positioned in front of the slider and enabling the slider to slide forward and backward in said inner cavity due to elasticity of the spring as said combining projection is respectively pressed and released;

said combination projection being integrally molded at the rear side of the slider, and separated from the back surface of the core-body by an interval so as to be movable forward and backward together with the slider; and a cavity-cover shielding said inner cavity after installing of said slider and spring such that both ends of said string is first installed so as to pass through the string-passageways of said necktie-arms, said core-body, and said slider, and converge at the bottom of said core-body, thus forming a tie-loop, and thereafter said necktie-body and said core-body are assembled so as to form the Y-shaped necktie wherein when said combining projection is pressed, the string-passageways of said core-body and the string-passageways of said slider become aligned, and said core-body is slidable along the strings of said tie-loop so as to tighten or loosen said tie-loop, whereas when the pressing force of said combining projection is released, said string-passageways are misaligned and said core-body is not slidable, thus fixing the length of said tie-loop.

* * * * *